United States Patent [19]

Brown, II

[11] Patent Number: 4,549,604

[45] Date of Patent: Oct. 29, 1985

[54] STEAM ABSORBER

[76] Inventor: William G. Brown, II, 720 N.W. 31st St., Corvallis, Oreg. 97330

[21] Appl. No.: 486,087

[22] Filed: Apr. 18, 1983

Related U.S. Application Data

[63] Continuation-in-part of Ser. No. 122,357, Feb. 14, 1980, abandoned, which is a continuation-in-part of Ser. No. 816,501, Jul. 17, 1977, abandoned, which is a continuation-in-part of Ser. No. 788,207, Apr. 18, 1977, abandoned.

[51] Int. Cl.[4] ..... F28B 1/00

[52] U.S. Cl. ..... 165/110; 261/153

[58] Field of Search ..... 261/153, DIG. 76; 165/110, 110 DC; 60/649, 673

[56] References Cited

U.S. PATENT DOCUMENTS

| | | | |
|---|---|---|---|
| 311,983 | 2/1885 | Heinzerling | 60/673 |
| 1,957,893 | 5/1934 | Lloyd | 60/649 |
| 2,005,377 | 6/1935 | Kasley | 122/21 |
| 4,122,680 | 10/1978 | Isshiki et al. | 60/649 |
| 4,307,572 | 12/1981 | Brinkerhoff | 60/649 |

*Primary Examiner*—Stephen F. Husar

[57] ABSTRACT

A steam absorber apparatus is described which consists of horizontal tubes submerged in desiccant brine with steam injected from a perforated box positioned beneath the tubes. The injected steam is absorbed into the brine, warming the brine, tubes, and water flowing within the tubes.

4 Claims, 2 Drawing Figures

FIG. 2

STEAM ABSORBER

REFERENCE TO RELATED PATENT APPLICATIONS

The present patent application is a continuation-in-part of pending U.S. patent application Ser. No. 122,357, entitled SOLAR POWER GENERATION by William G. Brown, filed Feb. 14, 1980, now abandoned, which in turn is a continuation-in-part of U.S. patent application Ser. No. 816,501, filed July 17, 1977, now abandoned, which in turn is a continuation-in-part of U.S. patent application Ser. No. 788,207, filed Apr. 18, 1977, also abandoned.

BACKGROUND OF THE INVENTION

The present invention relates to desiccant brine absorbers. Kasley, U.S. Pat. No. 2,005,377, sprayed brine on the outsides of tubes to absorb surrounding steam. Isshiki et al., U.S. Pat. No. 4,122,680, filled vertical tubes with desiccant brine to absorb steam injected through submerged nozzles. Because of the lack of agitation of the brine, Kasley's absorber suffered low absorption rates and uneven distribution of brine on the tube surfaces. For reasonably long vertical tubes, Isshiki's absorber requires excessive steam pressure to overcome the head of the desiccant brine in order to inject the steam. Also, backmixing of weakened desiccant with entering rich desiccant in the single absorber compartment causes the entire absorber to operate at the weakest concentration during continuous-type operation and hence at lower efficiency. One absorber described herein operates with horizontal tubes submerged in shallow brine with steam injected through a perforated box beneath. Partitions in the absorber prevent backmixing of weakened (desiccant) brine into rich brine for higher operation efficiency.

One object of the present invention is to absorb steam with minimum backpressure due to the head of the brine above the steam injectors. Another object is a low-cost steam injector. Another object is to maintain steady level of desiccant in the absorber whether or not steam is being injected. Still another object is to reduce backmixing of weak brine into rich brine admitted into the absorber thus to increase efficiency. Yet another object is to use low-cost tubes for the heat transfer surface of a reasonable, long length.

BRIEF DESCRIPTION OF DRAWINGS

Other objects and advantages of the present invention will become more apparent from the following detailed description of preferred embodiments thereof and from the attached drawings of which.

DETAILED DESCRIPTION OF PREFERRED EMBODIMENTS

Figure 1:
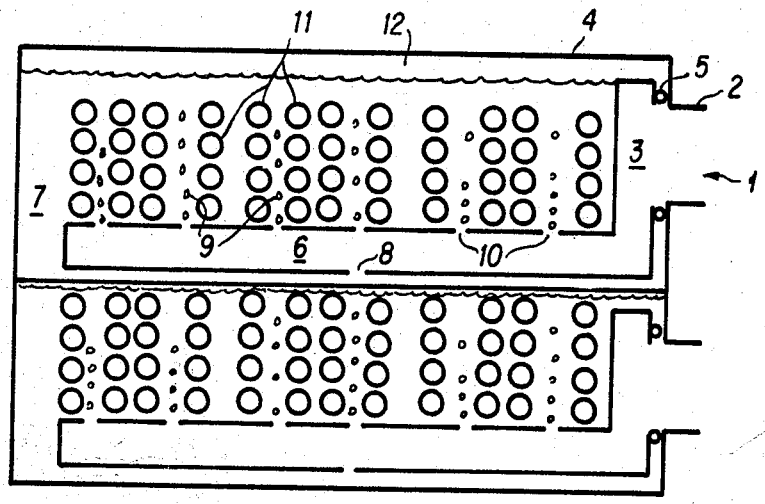
FIG. 1 is a cross-sectional end view of a submerged absorber.

FIG. 1 is a cross-sectional end view of a submerged absorber suitable for absorbing steam into a desiccant. Steam 1 enters through the port 2 into the duct 3 sealed from the upper absorber chamber 4 by the O-ring seal 5 and flows into the perforated box 6 submerged in brine 7. The steam displaces brine from the box, pushing brine out through the drain hole 8 and steam bubbles 9 out into the brine through the perforations 10. Slight positive pressure of steam in the box keeps brine out. As the brine 7 absorbs the steam bubbles 9 it warms up and heats the tubes 11. Residual steam and noncondensible gases rise to the vapor space 12 above the liquid level. In the preferred embodiment shown, steam is absorbed into and heats the brine in the absorber chamber 4, the heat then flowing through the walls of the tubes 11 which comprise the heat-transfer surface, to heat water in the space within the tubes 11 which comprises the heating chamber. The area of tube wall that contacts the brine and lies below the liquid level of the brine contacted is defined as the submerged portion of tube. The maximum straight-line horizontal distance of the submerged portion of a tube is defined as the horizontal extent of the tube. Where a plurality of tubes is employed, the horizontal extent is defined as the greatest horizontal extent of any one tube.

Figure 2:
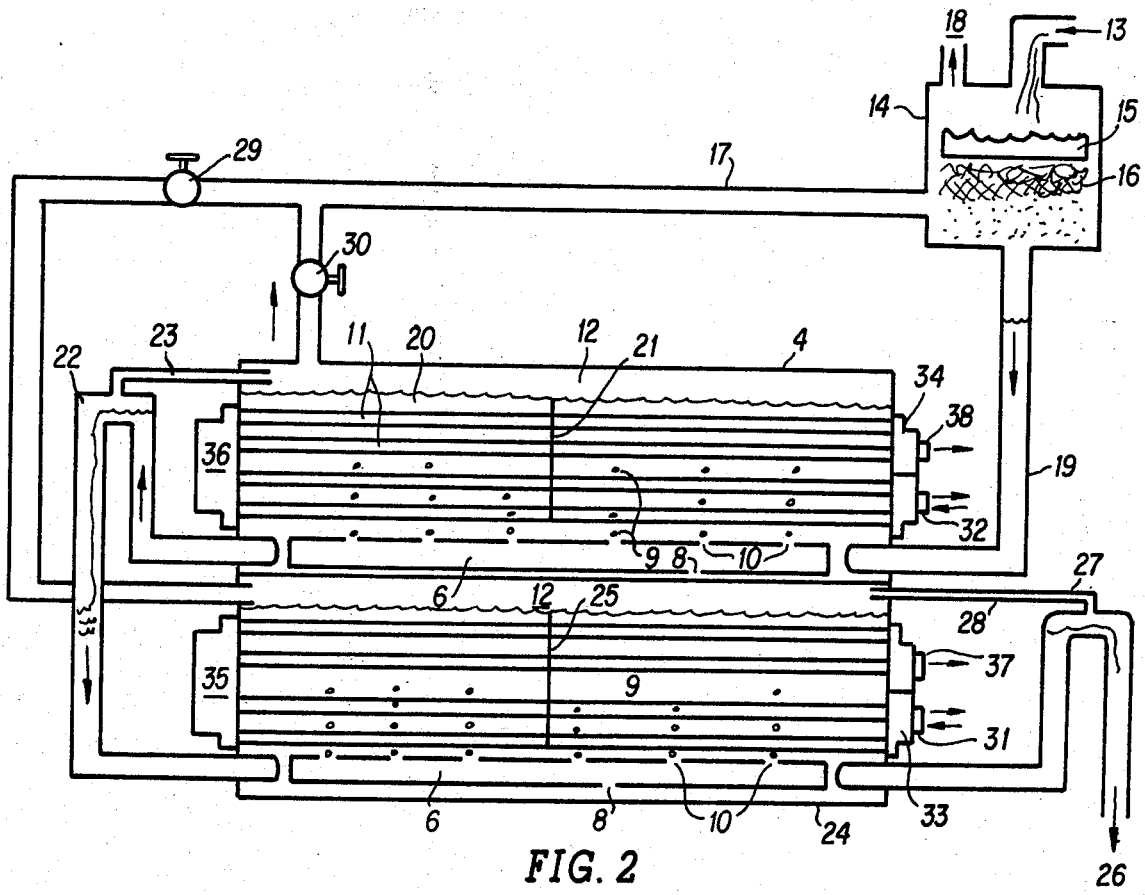
FIG. 2 is a cut-away side view of the submerged absorber.

FIG. 2 is a cut-away side view of the submerged absorber described in the preceding figure. Rich brine 13 flows into the purge chamber 14 and within into a perforated tray 15 to be distributed over the packing 16. The brine spreads out over a greater surface area due to the packing 16 which aids in absorbing residual steam 17 from the vapor spaces 12 leaving behind concentrated noncondensible gases to be vented 18. The rich brine then flows down the drain 19 into the upper absorber chamber 4. Here it absorbs steam bubbles 9 and becomes slightly weaker 20 as it flows past divider 21 toward U-tube 22. The brine will not siphon out of the U-tube 22 due to the anti-siphon tube 23. The brine, still weaker, flows down U-tube 22 into the lower absorber compartment 24. The brine absorbs steam and becomes slightly weaker as it advances past the divider 25. Note that the dividers 21 and 25 aid in preventing weaker brine from mixing with richer brine upstream, and in this sense provide a degree of isolation as the brine flows through the absorber as do the two separate compartments 4 and 24. Finally, the weakened brine 26 drains out of the U-tube 27 prevented from siphoning by the tube 28.

Residual steam and noncondensibles accumulate in the vapor spaces 12 and are drawn off through the throttling valves 29 and 30 which serve to balance steam flow between the compartments 4 and 24 by creating back-pressure in a compartment receiving excess steam. Residual steam is defined as steam with a higher concentration of noncondensible gases than steam entering the absorber and which fails to be absorbed into the desiccant in the absorber.

Heat generated as steam is absorbed into the brine and heats the outsides of the tubes 11. Water streams 31 and 32 entering the lower compartments of the bonnets 33 and 34 are heated within the tubes 11 before emerging into the bonnets 35 and 36 further heated in the tubes 11 before returning to the upper compartments of the bonnets 33 and 34 and emerging as streams 37 and 38.

It will be obvious to those having skill in the art that many changes may be made in the details of the above preferred embodiments of the invention. Therefore, the scope of the present invention should only be determined by the following claims.

I claim:

1. A steam absorber apparatus comprising:

an absorption chamber means suitable for holding a liquid desiccant in contact with a heat transfer means;

a heating chamber means suitable for holding water in contact with said heat-transfer means;

a heat-transfer surface means for thermally contacting said absorption chamber means with said heating chamber means comprising a tube;

a steam injector means suitable for injecting steam into said absorption chamber for absorption into said liquid desiccant;

a liquid level control means suitable for maintaining sufficient depth of said desiccant to submerge at least a portion of said tube and said injector means such that the major portion of said steam is injected below the surface of said liquid desiccant at a depth of less than half the horizontal extent of said tube to cause relatively low back pressure in said steam injector means while using a relatively long tube.

2. The steam absorption apparatus according to claim 1 wherein said steam injector means comprises a generally horizontal perforated plate suitable for feeding said steam upward toward said heat transfer surface.

3. The steam absorption apparatus according to claim 1 wherein said heat transfer surface comprises a plurality of generally horizontal tubes.

4. The steam absorption apparatus according to claim 3 wherein said steam injector means comprises a generally horizontal perforated plate suitable for feeding said steam upward toward said heat transfer surface.

* * * * *